US006374443B1

(12) United States Patent
Ancona et al.

(10) Patent No.: US 6,374,443 B1
(45) Date of Patent: Apr. 23, 2002

(54) CAN OPENER/ORGANIZER

(75) Inventors: Bruce Ancona, New York, NY (US); Robert A. Varakian, Edgewater, NJ (US)

(73) Assignee: Lectrix, LLC, Edgewater, NJ (US)

( * ) Notice: Subject to any disclaimer, the term of this patent is extended or adjusted under 35 U.S.C. 154(b) by 0 days.

(21) Appl. No.: 09/836,626

(22) Filed: Apr. 17, 2001

(51) Int. Cl.[7] ..... B25F 1/00
(52) U.S. Cl. ..... 7/110; 7/152
(58) Field of Search ..... 7/110, 151, 152

(56) References Cited

U.S. PATENT DOCUMENTS 3,159,912 A * 12/1964 Posener ..... 7/152 X
3,950,801 A * 4/1976 Morrison ..... 7/152
5,301,433 A * 4/1994 Rogers ..... 7/152 X

* cited by examiner

*Primary Examiner*—James G. Smith
(74) *Attorney, Agent, or Firm*—Cowan, Liebowitz & Latman, P.C.; Mark Montague, Esq.

(57) ABSTRACT

A combination electric can opener and kitchen organizer for utensils includes a container having front, rear and two side surfaces, a can opener assembly disposed at or near the front surface of the container for opening a can, indentations at the side surfaces for defining storage areas, and utensil holders disposed on the side surfaces to hold utensils within the defined storage areas. The container's two side surfaces are adjacent to and extend from the front surface at angles between 30 and 60 degrees, and the container includes an oval shaped top and an oval shaped base that extend over and below the storage areas to provide a single, compact device that performs the functions of both a can opener for opening cans and a kitchen organizer that stores kitchen utensils, gadgets and other items in a convenient and space efficient manner.

13 Claims, 2 Drawing Sheets

CAN OPENER/ORGANIZER

FIELD OF THE INVENTION

The present invention relates generally to kitchen appliances and, more particularly, to a combination electric can opener and organizer designed for ease of use and to provide the user with a number of advantageous features set forth below.

BACKGROUND OF THE INVENTION

Separately, can openers and so-called organizers for kitchen utensils and gadgets are well known. Can openers may be manually operated or automatic (for example, electric driven). Can openers also have been previously designed in a number of shapes and sizes.

Kitchen organizers also have been designed in a multitude of shapes and sizes.

Kitchen organizers seek to organize and store typical kitchen utensils such as spatulas, wooden spoons, etc., in an efficient manner.

Both electric can openers and kitchen organizers are used in countless homes throughout the world. Unfortunately, these devices require critical countertop space. Thus, there is a need to provide devices that carry out the functions of can openers and kitchen organizers that, at the minimum, require substantially less space than would otherwise be needed.

OBJECTS OF THE INVENTION

It is therefore an object of the present invention to provide a combined electric can opener and organizer that overcomes the shortcomings of existing can openers and kitchen organizers.

It is a further object of the present invention to provide a can opener/organizer that utilizes less space than required by current devices.

It is another object of the present invention to provide a can opener/organizer that has various other advantageous features not currently provided.

Various other objects, advantages and features of the present invention will become readily apparent to those of ordinary skill in the art, and the novel features will be particularly pointed out in the appended claims.

SUMMARY OF THE INVENTION

In accordance with an embodiment of the invention, a combination electric can opener and organizer is provided that includes a container having front, rear and two side surfaces, an electric can opener assembly disposed at or near the front surface of the container for opening a can, an indentation at a side surface for defining a storage area, and a utensil holder disposed on the side surface to hold a utensil within the defined storage area.

As an aspect of the invention, the side surface is adjacent to and extends from the front surface at an angle between 30 and 60 degrees.

As another aspect of the invention, the can opener and organizer combination includes a substantially oval top and a substantially oval base that extend over and below the storage area.

As a further aspect of the invention, both side surfaces are within indentations that define two storage areas, with each storage area including a respective utensil holder for holding utensils.

As an additional aspect of the invention, each side surface is adjacent to and extends from the container's front surface at an angle between 30 and 60 degrees.

As yet another aspect, the rear surface of the container is curved to match the contour of the oval shape of the top and base.

As yet a further aspect, the container includes a cavity, open at the top, that defines a storage compartment for holding tools, and the cavity's rear surface is curved to match the contour of the oval shape of the top and base.

As yet an additional aspect, the cavity is disposed at the rear of the container.

As a feature of this aspect, the cavity has a height extending from the top of the container to the base of the container, and the can opener assembly is adapted to accommodate and open a can with a height substantially equivalent to the height of the cavity.

As another feature, the can opener assembly includes a cutting lever that extends alongside the container's front surface and shaped to follow the oval shape of the container's top.

As a further feature, the container's top has a curved top surface, and the cutting lever has an end that follows the contour of the curved top surface.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

Figure 1:
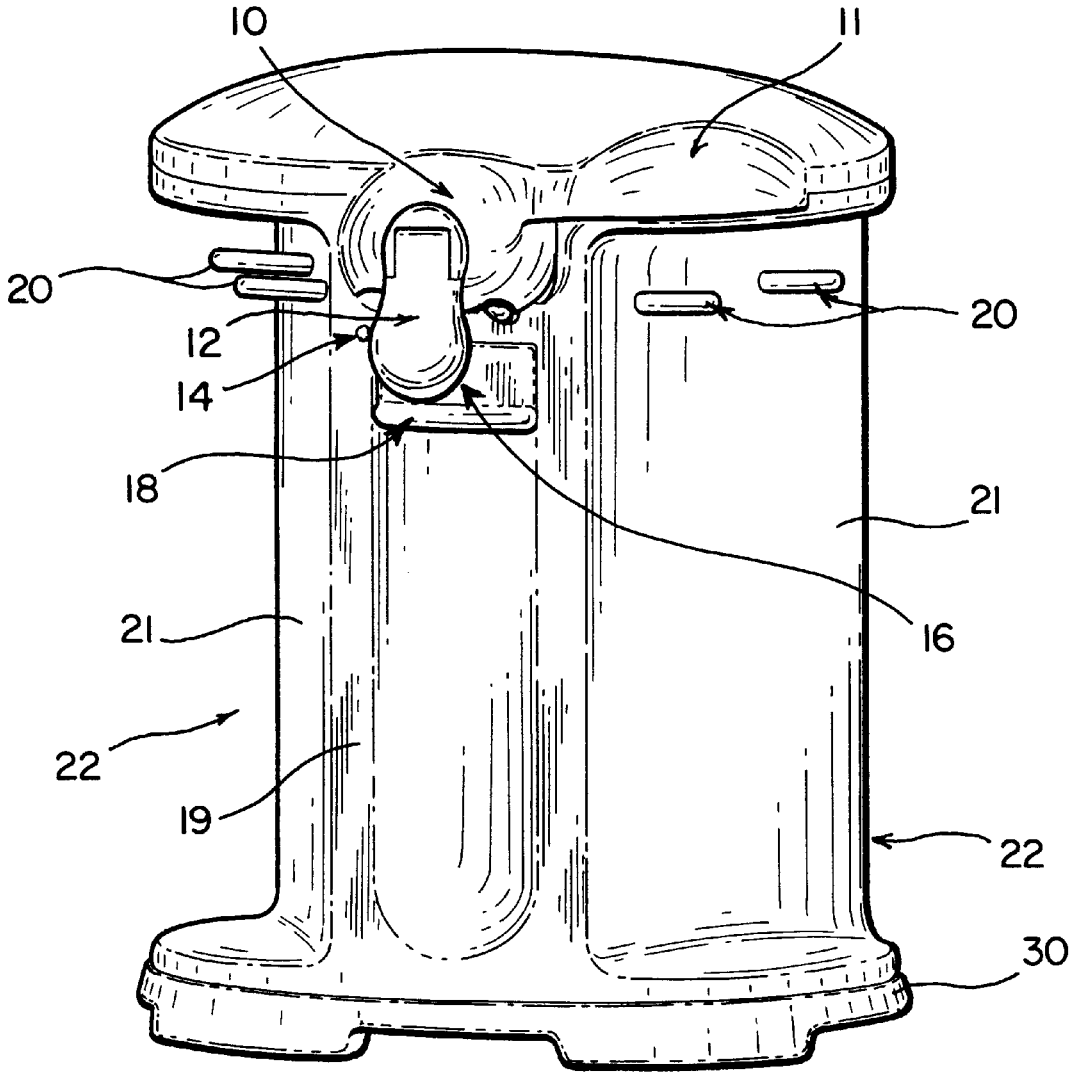
FIG. 1 is a schematic illustration of the combined can opener/organizer of the present invention.
Figure 2:
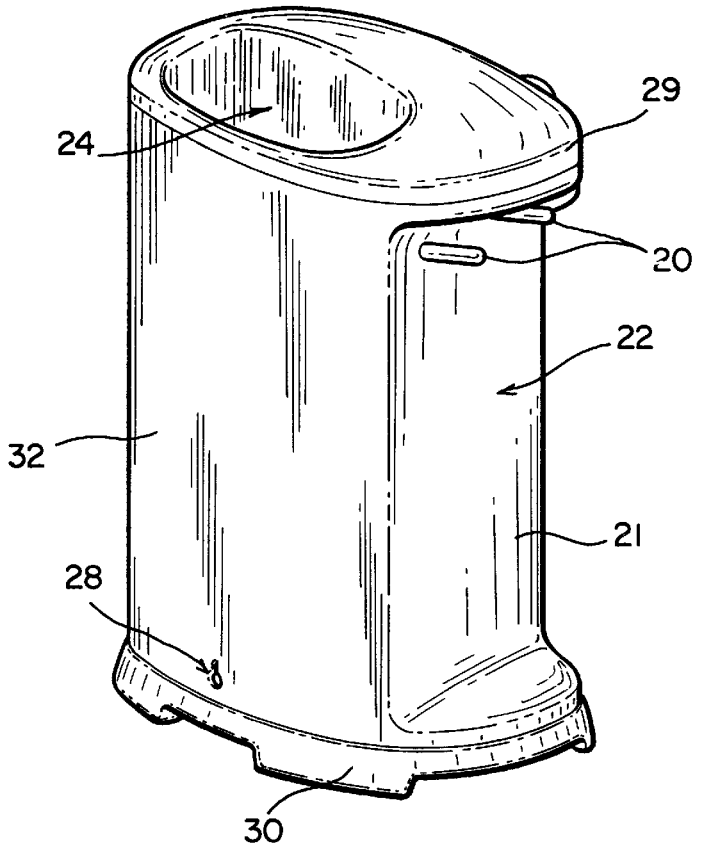
FIG. 2 is another schematic illustration of the can opener/organizer from a rear perspective.
Figure 3:
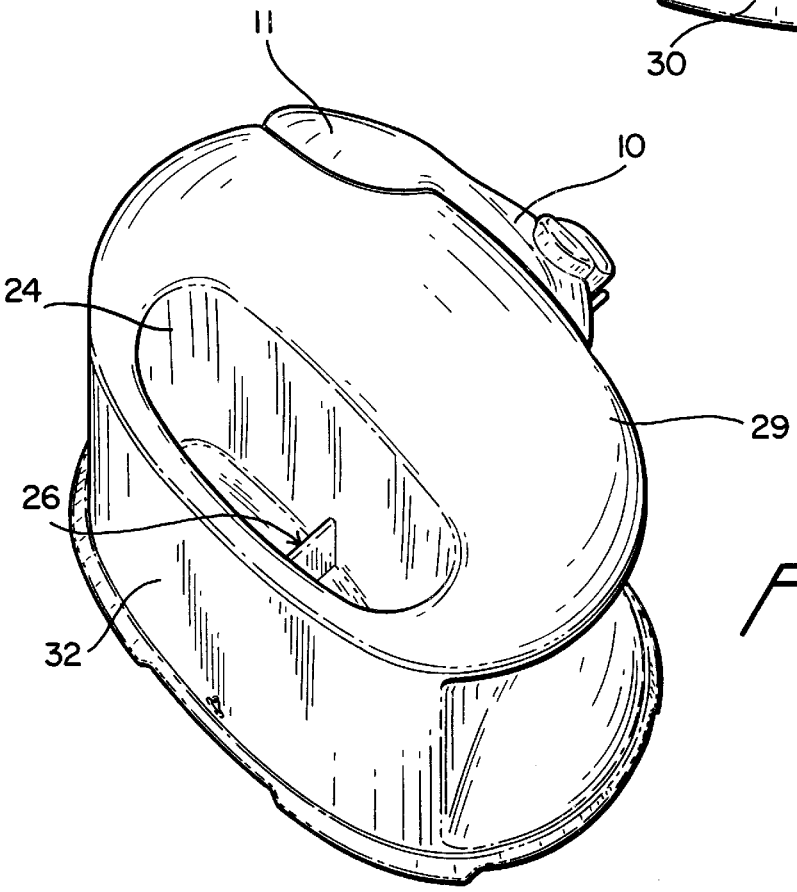
FIG. 3 is a further schematic illustration of the can opener/organizer from a top perspective.

Referring now to the drawings, FIGS. 1–3 show various views of the can opener/organizer combination of the present invention. As shown in FIG. 1, the can opener/organizer, hereinafter "opener-organizer," "opener-organizer combination," "device" or the like, includes various features and elements pertinent to the device's electric can opener function and various features and elements pertinent to the organizer function. Elements pertaining to the can opener (for convenience, reference to can opener is intended to mean an electric can opener) function include at least a cutting lever 10, a handle 11 for the cutting lever, a magnet 12, a can guide 14, a geared wheel 16 and a bump 18. Elements pertaining to the organizer function include at least hooks 20, indentations or gadget areas 22, a storage compartment 24, and a divider 26, which is disposed within the storage compartment The can opener/organizer further includes a cord storage/lock 28, a top portion or component 29 and a base 30.

Although not shown, the opener-organizer of the present invention further includes various internal components necessary to operate the can opener function, including a motor and appropriate gearing for collectively driving the geared wheel. The opener-organizer includes a power cord (not shown) that extends from within the opener-organizer through the opening in the rear represented by cord storage/lock 28. Various particular internal designs and components used to operate an electric can opener are well known in the art and are not considered pertinent to the present invention.

Thus, the internal structure and design of components internal to the opener-organizer of the present invention are not described herein except where necessary for an understanding of the present invention.

Referring again to FIG. 1, the opener-organizer is designed specifically to provide a single convenient and compact product that serves the functions of both an electric can opener and a kitchen organizer. As shown in FIG. 1, hooks 20 are provided along side surfaces (or walls) 21 disposed within the two gadget areas 22, which are disposed adjacent to the front surface 19 of the opener-organizer at about 45 degree angles thereof. The front surface 19 of the opener-organizer is utilized for opening a can which is placed adjacent to the front surface and the top of the can is urged upwards so that the can's rim is placed under geared wheel 16 in a manner well known in the art. The can then is opened in a manner well known in the art, that is, the cutting lever's handle 11 is depressed which causes the internal motor to turn geared wheel 16 thus cutting the can's lid. Magnet 12 swivels and operates to hold the lid once cut from the can.

In accordance with the present invention, the particular size and dimensions of the various components of the can opener function of the device are appreciated to be relatively small to allow nearby space and surfaces to be utilized for storage of kitchen utensils and other gadgets. The utilization of such space is quite different and not contemplated in prior art devices, whereby spaces and surfaces adjacent to and alongside the front surface of a can opener is unutilized. The present invention however maximizes such space by providing two appropriately sized gadget areas 22, as best shown in FIGS. 1 and 2. Two hooks 20 are disposed near the top of each of the gadget areas 22 and operate to hold typical kitchen gadgets and utensils, such as a peeler, a measuring spoon, etc. Moreover, the opener-organizer is of sufficient height to accommodate typical cans to be opened and such height of the device allows for gadget areas 22 likewise to be of sufficient height to accommodate many typical kitchen utensils. Still further, while the drawings show an opener-organizer having four hooks, two in each gadget area, any appropriate number of hooks (e.g., three) may be provided in each gadget area and the positions of those hooks within the gadget areas may differ from that shown. Also, the shapes of the hooks may be different. For example, some or all of the hooks may be looped in shape so that utensils and gadgets being held do not fall of the hooks in the event the opener-organizer is moved. Still further, looped hooks allow for the storage of more delicate items in the storage areas, such as tea cups and the like.

Referring to FIGS. 2 and 3, which best show the rear of the opener-organizer of the present invention, a storage compartment 24 is disposed in the rear of the device and may be used to store a variety of kitchen tools, utensils or appliances. For example, long wooden spoons, spatulas or other such items may be stored in compartment 24. In accordance with the present invention, storage compartment 24 is disposed within an electric device at a position that generally is not utilized in prior art designs (i.e., existing electric can openers). In the present invention, the various internal mechanisms, including the motor, are installed near the front of the opener-organizer. The rear of the opener-organizer, otherwise unutilized, is provided to include storage compartment 24 thus maximizing the utilization of space for storage of kitchen items. Moreover, storage compartment 24 is relatively deep and extends from the top surface 29 almost to base 30, leaving a small amount of space in the base for the power cord.

In accordance with the present invention, the height of the opener-organizer is designed relatively tall to accommodate relatively tall cans to be opened and, likewise, storage compartment 24 is provided equally tall (i.e., deep) to accommodate relatively long utensils. Further, storage compartment 24 is provided with a divider 26 which functions to keep tools and utensils within the compartment erect. Additional dividers can be included as appropriate.

FIG. 2 shows cord storage/lock 28, which is an aperture disposed near the bottom of the rear surface 32 of the opener-organizer. A storage space (not shown) is disposed within the opener-organizer and immediately in front of cord storage/lock 28 for stowing away the device's electrical power cord (also not shown). Cord storage/lock 28 is shaped to include a generally round portion through which the can slide and a relatively narrow, flat portion that functions as the lock when the power cord is forced into this flat portion of cord storage/lock 28.

As previously discussed, the can opener feature of the present invention opens a can by using the various components shown in FIG. 1. Such a can be opened without holding the can in place and without the need to hold down cutting lever 10, or its handle 11, while the can is being cut. As previously mentioned, magnet 12 is designed to hold up the lid upon completion of cutting. Moreover, magnet 12 also is designed to flip up to enable the user to check the positioning of the can within the device, can guide 14 assists the user to correctly position the can, and bump 18 maintains the can in an upright position for easy cutting.

As best shown in FIG. 3, both top 29 and base 30 of the opener-organizer are oval in shape, and top 29 has a rounded top surface. Top 20 and base 30 extend past side walls 21 thus defining the two gadget areas 22. Preferably, all of the hooks 20 extending from the side walls 21 do not extend beyond the top and base. Rear surface 32 is curved and follows the contour of the oval-shape of the top and base. The two side walls 21 extend from the front surface 19 (see FIG. 1) at an angle within the range of 30to 60 degrees, or perhaps even beyond this range, to provide suitably sized gadget areas 22 and, at the same time, to allow sufficient space between the side walls at the rear of the opener-organizer to provide a sufficiently sized storage compartment 24. With the design shown, an oval-shaped device is provided that includes a can opener on its front surface, two gadget areas 22 along the two sides sufficient to store utensils and gadgets, and a deep storage area 24 sufficiently sized to store long utensils, all within a single device.

As also shown in FIG. 3, handle 11 of the cutting lever 10 is designed to have a large format for ease of use and designed to follow the contour of the oval shape of top 29, and further follows the contour of the curved top surface of top 29. Thus, even with various elements that carry out the can opener function of the invention, the opener-organizer of the present invention is reasonably sized and oval in shape, in accordance with the present embodiment. Of course, other sizes and shapes are possible, including round, rectangular, square, triangular, hexagonal, etc. Finally, base 30 includes four feet to provide stability to the opener-organizer, with silicon rubber pads or the like disposed on the feet for anti-slip performance.

While the present invention has been particularly shown and described in conjunction with a preferred embodiment thereof, it will be readily appreciated by those of ordinary skill in the art that various changes may be made without departing from the spirit and scope of the invention. For example, although only two gadget areas 22 and a single storage compartment 24 have been shown, the present invention is not limited to this design and may include additional gadget areas and storage compartments.

As another example, although the present discussion is directed to a can opener/organizer generally for kitchen use, the present invention is not limited solely for use in the kitchen and may be widely applied to other areas of use where cans need to be opened.

Therefore, it is intended that the appended claims be interpreted as including the embodiments described herein, the alternatives mentioned above, and all equivalents thereto.

What is claimed is:

1. A combination can opener and organizer, comprising:

a container having at least a front surface, a rear surface and two side surfaces;

a can opener assembly disposed at or near the front surface of the container and adapted to open a can;

at least one of the side surfaces being within an indentation of the container, the indentation defining a storage area; and a utensil holder disposed on said at least one of the side surfaces and adapted to hold a utensil within the storage area.

2. The combination of claim 1, where said at least one of the side surfaces is adjacent to and extends from the front surface of the container at an angle between 30 and 60 degrees.

3. The combination of claim 2, further comprising a substantially oval top and a substantially oval base that extend over and below, respectively, the storage area, said top and base having substantially the same shape.

4. The combination of claim 1, wherein the other of said side surfaces is within a second indentation of the container, the second indentation defining a second storage area, said combination further including a second utensil holder disposed on the other of said side surfaces and adapted to hold a utensil within the second storage area.

5. The combination of claim 4, where each of said side surfaces is adjacent to and extends from the front surface of the container at an angle between 30 and 60 degrees.

6. The combination of claim 5, further comprising a substantially oval top and a substantially oval base that extend over and below, respectively, both of the first and second storage areas, said top and base having substantially the same shape.

7. The combination of claim 6, wherein the rear surface of the container extends between rear portions of said two side surfaces, and the rear surface is curved in shape to match a contour of the substantially oval shape of the top and base.

8. The combination of claim 7, further comprising a cavity disposed within the container and open at the top for defining a storage compartment for tools, the cavity having a rear surface curved in shape to match the contour of the substantially oval shape of the top and base.

9. The combination of claim 8, wherein the cavity is disposed at a rear portion of the container.

10. The combination of claim 9, wherein the cavity has a height that extends from the top of the container to substantially the base of the container, and the can opener assembly is adapted to accommodate and open a can with a height substantially equivalent to the height of the cavity.

11. The combination of claim 1, further comprising a cavity disposed within the rear of the container for defining a vertical storage compartment for tools.

12. The combination of claim 1, further comprising a substantially oval top, the can opener assembly including a cutting lever extending alongside the front surface of the container and shaped to have a contour following the substantially oval shape of the top of the container.

13. The combination of claim 12, wherein the top of the container has a curved top surface, and the cutting lever includes a first end rotatably coupled to a center of the front surface of the container and a second end with a shape that follows a contour of the curved top surface of the top.

* * * * *